US006968070B1

(12) United States Patent
Chiang

(10) Patent No.: US 6,968,070 B1
(45) Date of Patent: Nov. 22, 2005

(54) MICROPHONE

(76) Inventor: Kun-Tien Chiang, No. 85, Chang-Hsing 1st St., Jen-Te Hsiang, Tainan Hsien (TW)

( * ) Notice: Subject to any disclaimer, the term of this patent is extended or adjusted under 35 U.S.C. 154(b) by 11 days.

(21) Appl. No.: 10/896,531

(22) Filed: Jul. 22, 2004

(51) Int. Cl.[7] ..... H04R 25/00
(52) U.S. Cl. ..... 381/361; 381/355; 381/360; 429/100
(58) Field of Search ..... 381/355, 359, 381/360, 361, 362, 363, 366, 323; 429/97, 429/98, 100

(56) References Cited

U.S. PATENT DOCUMENTS 6,463,159 B1 * 10/2002 Ming-Cheng ..... 381/355
6,671,382 B2 * 12/2003 Chen ..... 381/355
2004/0018420 A1 * 1/2004 Nakajima et al. ..... 429/97

* cited by examiner

*Primary Examiner*—Huyen Le
(74) *Attorney, Agent, or Firm*—Ostrolenk, Faber, Gerb & Soffen, LLP

(57) ABSTRACT

A microphone includes a tubular handgrip extending in a longitudinal direction, confining an accommodating space, and having a surrounding wall formed with an opening for access into the accommodating space. A battery-mounting seat is mounted in the accommodating space, and is formed with a battery-receiving groove that extends in the longitudinal direction and that has an open side facing the opening in the surrounding wall of the handgrip. A cover plate is connected pivotally to the battery-mounting seat, and is disposed adjacent to the open side of the battery-receiving groove. A sleeve is sleeved detachably on the surrounding wall of the handgrip for covering the opening in the surrounding wall.

7 Claims, 5 Drawing Sheets

MICROPHONE

BACKGROUND OF THE INVENTION

1. Field of the Invention

The invention relates to a microphone, more particularly to a battery-operated wireless microphone.

2. Description of the Related Art

A conventional wireless microphone usually utilizes a battery set mounted therein as a power source. In the conventional wireless microphone, the battery set is received in a battery-mounting seat that is disposed in a sleeve. In such a configuration, the battery set cannot be effectively positioned such that the battery set may wobble between the battery seat and the sleeve whenever the conventional wireless microphone is waved, thereby resulting in signal interruption during use.

SUMMARY OF THE INVENTION

Therefore, the object of the present invention is to provide a microphone that includes a cover plate for firmly positioning a battery in a battery-mounting seat.

According to the present invention, a microphone comprises:

- a tubular handgrip extending in a longitudinal direction, confining an accommodating space, and having a surrounding wall formed with an opening for access into the accommodating space;
- a battery-mounting seat mounted in the accommodating space and formed with a battery-receiving groove that extends in the longitudinal direction and that has an open side facing the opening in the surrounding wall of the handgrip;
- a cover plate connected pivotally to the battery-mounting seat and disposed adjacent to the open side of the battery-receiving groove; and
- a sleeve sleeved detachably on the surrounding wall of the handgrip for covering the opening in the surrounding wall.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
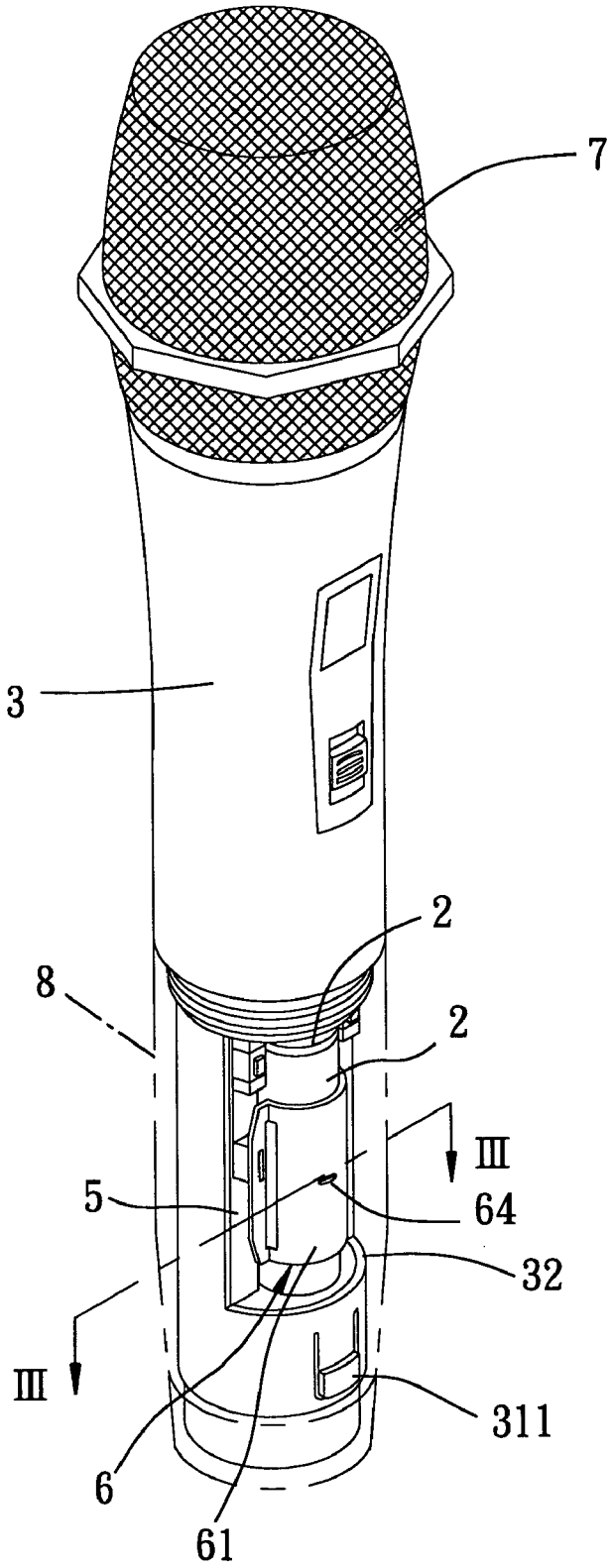
FIG. 1 is a perspective view showing the preferred embodiment of a microphone according to the present invention.

Referring to FIG. 1, the preferred embodiment of a microphone, such as a battery-operated wireless microphone, according to the present invention is shown to include a tubular handgrip 3, a battery-mounting seat 5, a cover plate 6, a sleeve 8, and an anchoring unit.

Figure 2:
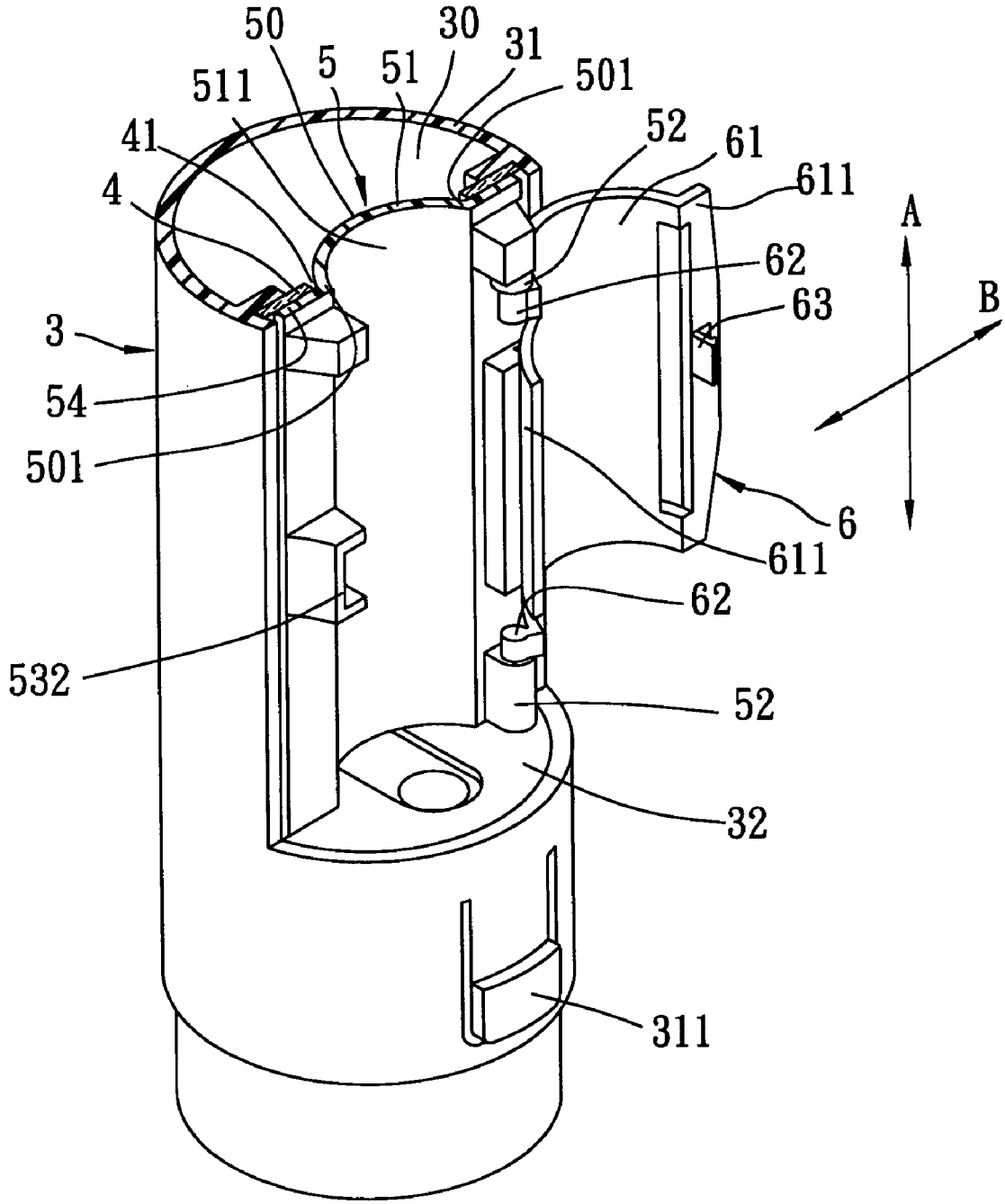
FIG. 2 is a fragmentary perspective view of the preferred embodiment, illustrating how a cover plate is connected pivotally to a battery-mounting seat.
Figure 3:
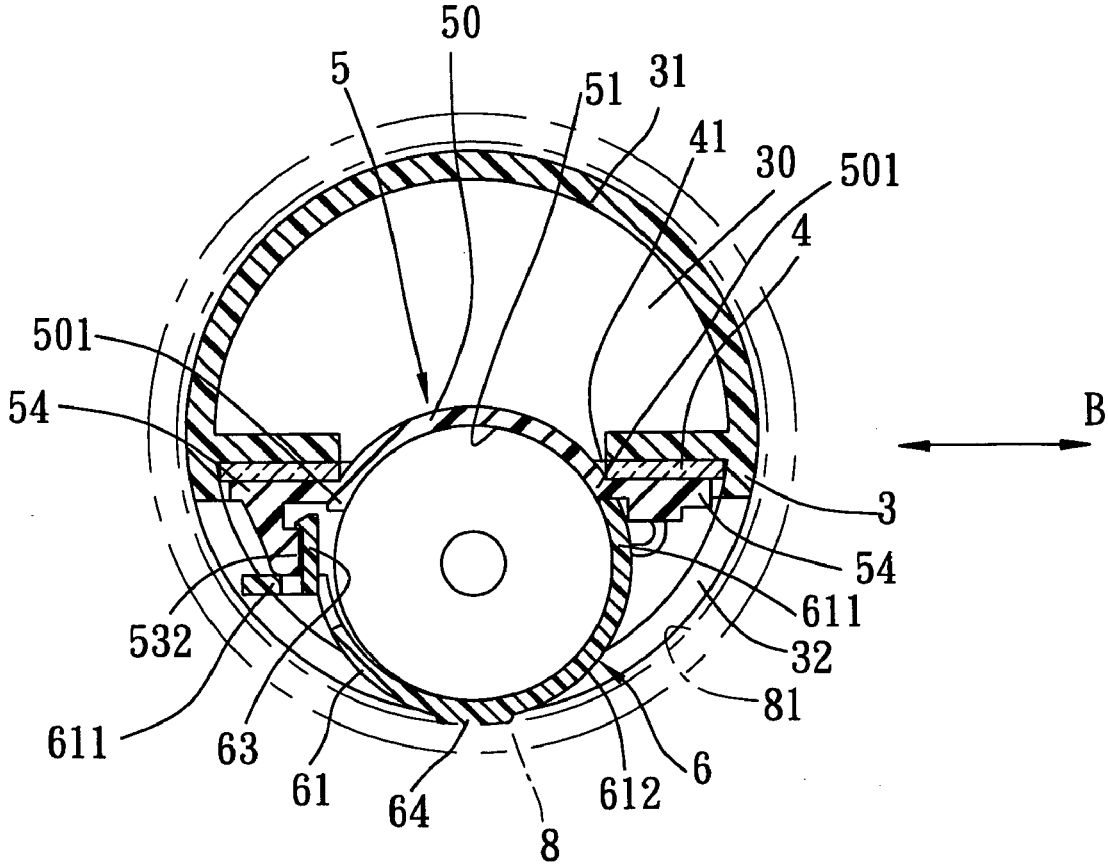
FIG. 3 is a schematic sectional view of the preferred embodiment, taken along line III—III in FIG. 1.

Referring further to FIGS. 2 and 3, the handgrip 3 extends in a longitudinal direction (A), confines an accommodating space 30, and has a surrounding wall 31 formed with an opening 32 for access into the accommodating space 30. In this embodiment, a sound collector 7 (see FIG. 1) is mounted on an upper end of the handgrip 3 for receiving audio signals in a known manner.

The battery-mounting seat 5 is mounted in the accommodating space 30, and is formed with a battery-receiving groove 51 that extends in the longitudinal direction (A) and that has an open side 511 facing the opening 32 in the surrounding wall 31 of the handgrip 3. In this embodiment, the battery-mounting seat 5 includes a U-shaped plate portion 50 that extends in the longitudinal direction (A), that confines the battery-receiving groove 51, and that has two lateral ends 501 opposite to each other in a transverse direction (B) transverse to the longitudinal direction (A), and opposite flange portions 54 that extend respectively from the lateral ends 501 of the U-shaped plate portion 50 away from each other in the transverse direction (B). In this embodiment, the battery-receiving groove 51 is capable of receiving two batteries 2, an upper one of which is almost fully-concealed by the surrounding wall 31 of the handgrip 3, and a lower one of which is fully exposed via the opening 32.

A circuit board 4 is mounted in the accommodating space 30, and is connected electrically to the sound collector 7 for wirelessly transmitting the audio signals from the sound collector 7 in a known manner. Since the circuit board 4 is irrelevant to the claimed invention, a detailed description of the same is omitted herein for the sake of brevity.

The cover plate 6 is connected pivotally to the battery-mounting seat 5, and is disposed adjacent to the open side 511 of the battery-receiving groove 51. In this embodiment, the cover plate 6 includes a resilient U-shaped plate body 61 having opposite lateral sides 611, a first one of which is connected pivotally to a first one of the flange portions 54 of the battery-mounting seat 5. In this embodiment, the first one of the flange portions 54 of the battery-mounting seat 5 is formed with a pair of pivot lugs 52 spaced apart from each other in the longitudinal direction (A). The first one of the lateral sides 611 of the resilient U-shaped plate body 61 of the cover plate 6 is formed with a pair of pivot posts 62 that engage pivotally and respectively the pivot lugs 52, as best shown in FIG. 2.

Figure 4:
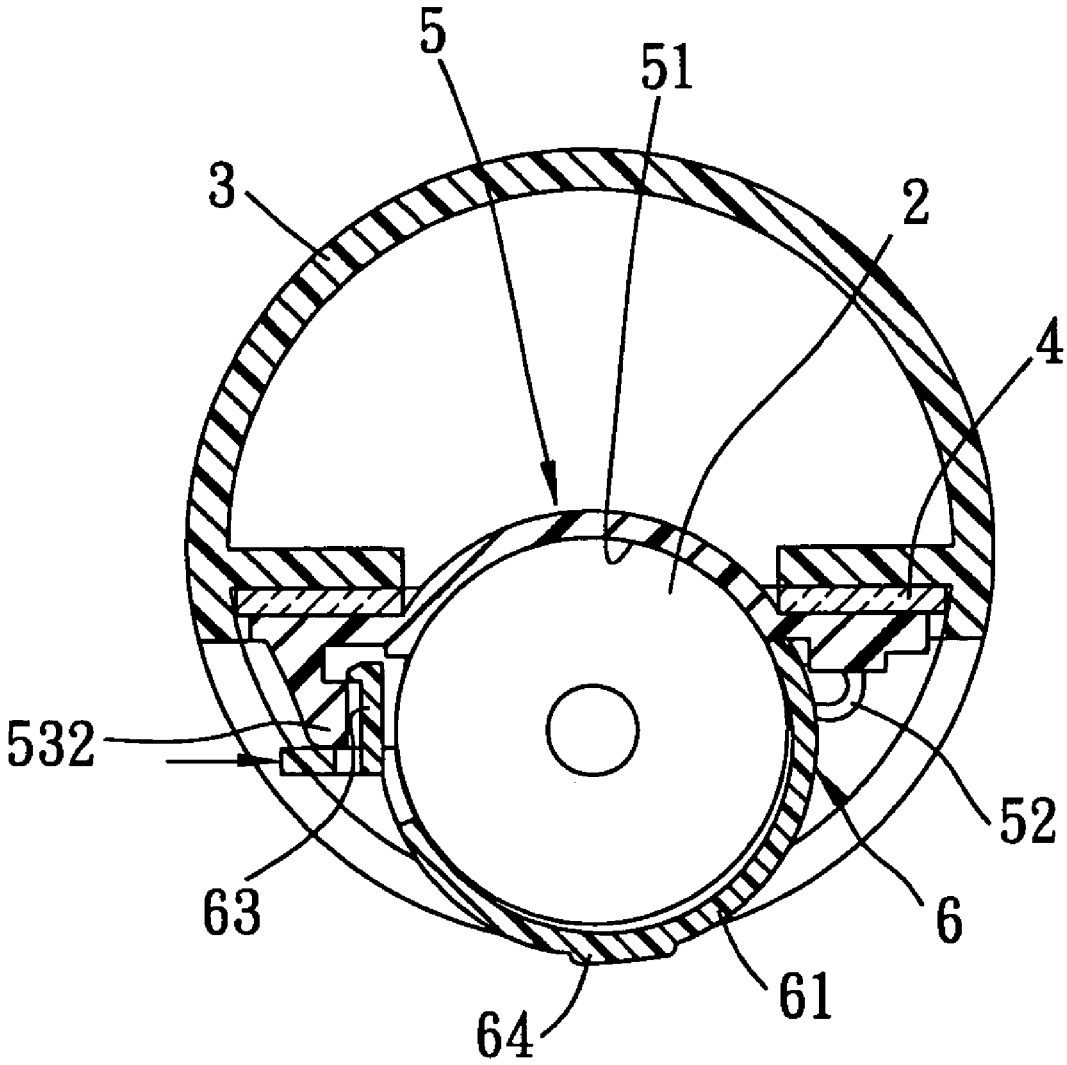
FIG. 4 is a schematic sectional view of the preferred embodiment of FIG. 3, illustrating how an engaging lug is disengaged from an engaging rib after removal of a sleeve.

The anchoring unit is provided on the cover plate 6 and the battery-mounting seat 5 for anchoring releasably the cover plate 6 to the battery-mounting seat 5 such that when the cover plate 6 covers the open side 511 of the battery-receiving groove 51, the cover plate 6 is capable of positioning the lower one of the batteries 2 that are received in the battery-receiving groove 51. In this embodiment, the anchoring unit includes an engaging rib 532 formed on a second one of the flange portions 54 of the battery-mounting seat, and an engaging lug 63 formed on a second one of the lateral sides 611 of the resilient U-shaped plate body 61 for engaging releasably the engaging rib 532, as shown in FIG. 3. It is noted that the engaging lug 63 is moved away from the engaging rib 532 when the resilient U-shaped plate body 61 is pressed such that the engaging lug 63 disengages the engaging rib 532, as shown in FIG. 4.

Figure 5:
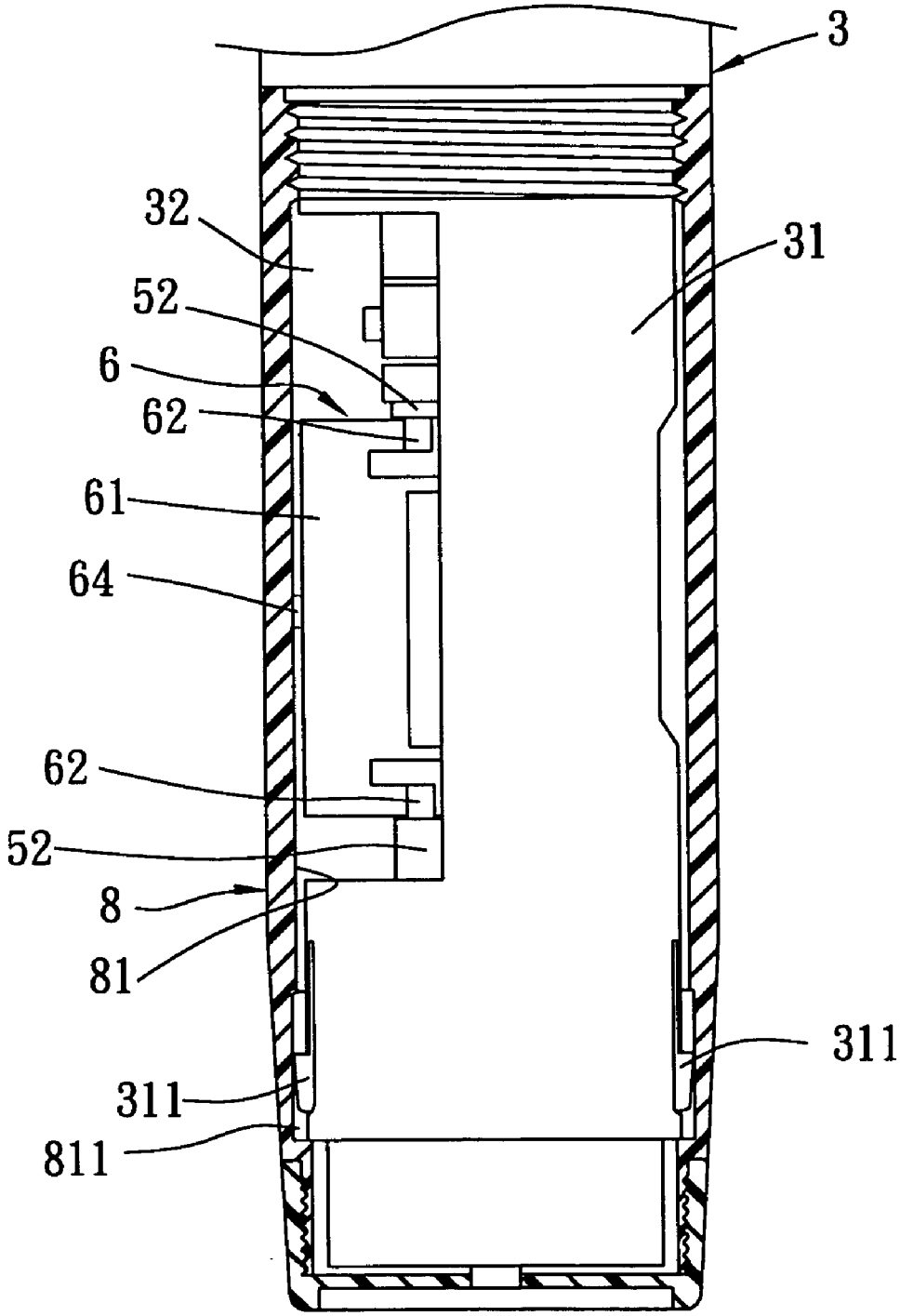
FIG. 5 is a fragmentary, partly sectional schematic view of the preferred embodiment.

The sleeve 8 is sleeved detachably on the surrounding wall 31 of the handgrip 3 for covering the opening 32 in the surrounding wall 31, as shown in FIG. 5. In this embodiment, the sleeve 8 has an inner surrounding surface 81. The resilient U-shaped plate body 61 of the cover plate 6 has an outer surface 612 that is formed with a stub 64 to abut against the inner surrounding surface 81 of the sleeve 8 when the sleeve 8 is sleeved on the surrounding wall 31 of the handgrip 3, as best shown in FIG. 3. Furthermore, the inner surrounding surface 81 of the sleeve 8 is formed with an annular groove 811, as shown in FIG. 5. The surrounding wall 31 of the handgrip 3 is formed with two resilient engaging pieces 311 that engage releasably the annular groove 811 when the sleeve 8 is sleeved on the surrounding wall 31 of the handgrip 3.

To sum up, due to the presence of the cover plate 6, the batteries 2 can be firmly positioned in the battery-mounting seat 5, thereby avoiding undesired signal interruption when the microphone of this invention is in use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A microphone comprising:

a tubular handgrip extending in a longitudinal direction, confining an accommodating space, and having a surrounding wall formed with an opening for access into said accommodating space;

a battery-mounting seat mounted in said accommodating space and formed with a battery-receiving groove that extends in the longitudinal direction and that has an open side facing said opening in said surrounding wall of said handgrip;

a cover plate connected pivotally to said battery-mounting seat and disposed adjacent to said open side of said battery-receiving groove; and a sleeve sleeved detachably on said surrounding wall of said handgrip for covering said opening in said surrounding wall.

2. The microphone as claimed in claim 1, further comprising an anchoring unit provided on said cover plate and said battery-mounting seat for anchoring releasably said cover plate to said battery-mounting seat such that when said cover plate covers said open side of said battery-receiving groove, said cover plate is capable of positioning a battery that is received in said battery-receiving groove.

3. The microphone as claimed in claim 2, wherein:

said battery-mounting seat includes a U-shaped plate portion that extends in the longitudinal direction, that confines said battery-receiving groove, and that has two lateral ends opposite to each other in a transverse direction transverse to the longitudinal direction, and opposite flange portions that extend respectively from said lateral ends of said U-shaped plate portion away from each other in the transverse direction;

said cover plate including a resilient U-shaped plate body having opposite lateral sides, one of which is connected pivotally to one of said flange portions of said battery-mounting seat; and said anchoring unit including an engaging rib formed on the other one of said flange portions of said battery-mounting seat, and an engaging lug formed on the other one of said lateral sides of said resilient U-shaped plate body for engaging releasably said engaging rib.

4. The microphone as claimed in claim 3, wherein said resilient U-shaped plate body has an outer surface, said sleeve having an inner surrounding surface that abuts against said outer surface of said resilient U-shaped plate body when said sleeve is sleeved on said surrounding wall of said handgrip.

5. The microphone as claimed in claim 4, wherein said outer surface of said resilient U-shaped plate body is formed with a stub that abuts against said inner surrounding surface of said sleeve when said sleeve is sleeved on said surrounding wall of said handgrip.

6. The microphone as claimed in claim 4, wherein said inner surrounding surface of said sleeve is formed with an annular groove, said surrounding wall of said handgrip being formed with a resilient engaging piece that engages releasably said annular groove when said sleeve is sleeved on said surrounding wall of said handgrip.

7. The microphone as claimed in claim 3, wherein said one of said flange portions of said battery-mounting seat is formed with a pair of pivot lugs that are spaced apart from each other in the longitudinal direction, said one of said lateral sides of said resilient U-shaped plate body of said cover plate being formed with a pair of pivot posts that engage pivotally and respectively said pivot lugs.

* * * * *